US008117968B2

(12) United States Patent
Rose et al.

(10) Patent No.: US 8,117,968 B2
(45) Date of Patent: Feb. 21, 2012

(54) MAGNETIC PACER FOR CONTROLLING SPEEDS IN AMUSEMENT PARK RIDES

(75) Inventors: Christopher J. Rose, Canyon Country, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 1000 days.

(21) Appl. No.: 11/934,899

(22) Filed: Nov. 5, 2007

(65) Prior Publication Data

US 2009/0114114 A1 May 7, 2009

(51) Int. Cl.
*A63G 1/00* (2006.01)

(52) U.S. Cl. ..... 104/53

(58) Field of Classification Search ..... 104/53, 104/60, 284; 310/180; 340/407.2
See application file for complete search history.

(56) References Cited

U.S. PATENT DOCUMENTS

| | | | | |
|---|---|---|---|---|
| 4,381,478 | A | 4/1983 | Saijo et al. | |
| 4,991,514 | A | 2/1991 | Powell et al. | |
| 5,605,100 | A | 2/1997 | Morris et al. | |
| 5,669,821 | A | 9/1997 | Prather et al. | |
| 5,931,099 | A * | 8/1999 | Bruner et al. | 104/53 |
| 6,011,508 | A | 1/2000 | Perreault et al. | |
| 6,060,847 | A | 5/2000 | Hettema et al. | |
| 6,062,350 | A | 5/2000 | Spieldiener et al. | |
| 6,100,874 | A * | 8/2000 | Schena et al. | 345/157 |
| 6,101,952 | A | 8/2000 | Thornton et al. | |
| 6,170,402 | B1 | 1/2001 | Rude et al. | |
| 6,327,979 | B1 * | 12/2001 | Ochi | 104/84 |
| 6,341,564 | B1 * | 1/2002 | Ochi | 104/53 |
| 6,397,755 | B1 * | 6/2002 | Kamler | 104/53 |
| 6,499,701 | B1 | 12/2002 | Thornton et al. | |

(Continued)

FOREIGN PATENT DOCUMENTS

EP 1829592 A1 9/2007

OTHER PUBLICATIONS

Annex to Form PCT/ISA/206, Communication Relating to the Results of the Partial International Search, International Application No. PCT/US2008/081684, The present communication is an Annex to the invitation to pay additional fees. It show the results of the international search dated Jul. 15, 2010.

*Primary Examiner* — James Trammell
*Assistant Examiner* — Majdi Alsomiri
(74) *Attorney, Agent, or Firm* — Marsh Fischmann & Breyfogle LLP; Kent A. Lembke

(57) ABSTRACT

A magnetic pacer system and method for adjusting vehicle speed in an amusement park ride. The system includes a controller and memory that stores speed settings such as upper and lower speed limits for the vehicle in a specific portion of a ride. A magnetic thruster is positioned near the portion of the ride, and a signal or signals are sent from position sensors to the controller. The controller determines the actual velocity of the vehicle as it travels along a direction of travel and acts to compare the determined vehicle velocity with the stored and desired speed settings. The controller then determines a magnetic force to apply to the vehicle including selecting whether the force is along the direction of travel or opposite to provide acceleration or deceleration of the vehicle. The magnetic thruster is selectively operated to generate a magnetic force to act on the vehicle.

16 Claims, 6 Drawing Sheets

U.S. PATENT DOCUMENTS 6,550,392 B2 4/2003 Albrich
6,578,495 B1 6/2003 Yitts et al.
6,781,524 B1 8/2004 Clark et al.
6,782,831 B2 * 8/2004 Yamada ..... 104/53
6,876,896 B1 4/2005 Ortiz et al.
6,983,701 B2 1/2006 Thornton et al.
7,484,463 B2 * 2/2009 Li ..... 104/281
7,737,686 B2 * 6/2010 Schmid et al. ..... 324/207.26
2003/0126980 A1 * 7/2003 Barden ..... 91/434
2004/0119358 A1 6/2004 Thornton et al.
2006/0219124 A1 10/2006 Jordan
2007/0089630 A1 4/2007 Gordon
2007/0261589 A1 * 11/2007 Bussink ..... 104/53
2007/0265103 A1 * 11/2007 Roodenburg et al. ..... 472/43
2008/0297328 A1 * 12/2008 Crawford et al. ..... 340/407.2
2010/0236444 A1 * 9/2010 Blonk et al. ..... 104/53

* cited by examiner

MAGNETIC PACER FOR CONTROLLING SPEEDS IN AMUSEMENT PARK RIDES

BACKGROUND OF THE INVENTION

1. Field of the Invention

The present invention relates, in general, to roller coasters and other amusement park rides, and, more particularly, to systems and methods for selectively and accurately controlling the speed and, thereby, the energy of cars or vehicles carrying passengers in an amusement park ride at specific locations such as during a show portion of the ride in which visual and/or audio effects are provided as part of the ride experience or to control the overall energy of the vehicle to ensure consistent and safe system performance.

2. Relevant Background

Amusement parks continue to be popular worldwide with hundreds of millions of people visiting the parks each year. Park operators continuously seek new designs for extreme or thrill rides because these rides attract large numbers of people to their parks each year, and roller coasters and other thrill rides provide numerous twists, turns, drops, and loops at high speeds. However, in addition to high-speed or thrill portions of rides, many rides incorporate a slower portion or segment to their rides to allow them to provide a "show" in which animation, movies, three-dimensional (3D) effects and displays, audio, and other effects are presented as vehicles proceed through such show portions. The show portions of rides are often run or started upon sensing the presence of a vehicle and are typically designed to be most effective when the vehicle travels through the show portion at a particular speed.

For example, a roller coaster may be designed such that in a show portion dinosaurs attack the vehicles, meteors fly toward the passengers, animatronic figures perform, and the like. The show may be designed based on the anticipated speed of the vehicle after it enters the show portion such that an effect such as 3D "attack" on the vehicle occurs precisely when the vehicle is adjacent to a portion of the display screens, speakers, and/or other show equipment. Some 3D imagery is achieved with a screen that rotates with the passing vehicle to maintain the desired effect and such rotation requires that the vehicle be traveling at a known speed. Other rides are designed such that the show includes jets, streams, and other water effects that require knowledge of vehicle position and speed to achieve desired effects such as water passing near passengers without striking the passengers or vehicle. Other rides are used to tell stories, and it is desirable to control the speed or pace of the vehicles during show sections of the ride so the passengers can enjoy the set, which may include special effects that are sensitive to or synchronized to vehicle speed (e.g., a multimedia presentation may actually be intentionally distorted such that it appears normal to passengers in a vehicle when the vehicle is moving at a particular speed but when the vehicle is moving too fast or too slow the distortion may be seen). Ride designers or engineers are given the task of producing unique and more exciting rides that mix thrill and show portions in which both portions of the ride are effective while also providing rides that are less costly to operate and maintain.

To date, controlling speed of vehicles in amusement rides to the degree of accuracy demanded by show designers has proven difficult especially in the case of roller coasters. A roller coaster is made up of a number of cars or vehicles that are connected like a passenger train, but roller coasters are typically not self-powered. Instead, for most of the ride, the train or vehicles are moved by gravity and momentum. To build up potential energy, a chain or cable is used to lift the train to a first peak or lift hill and the train is released with its potential energy becoming kinetic energy as the train accelerates to a high velocity in the first downward slope. The initial potential energy is enough to complete the entire track or course of the ride, and the train is stopped by mechanical or magnetic brakes that remove any remaining kinetic energy. In some cases, the train is set in motion by a launch mechanism such as a flywheel launch, a linear induction motor (LIM), a linear synchronous motor (LSM), a hydraulic launch, and the like that apply a force to the captured train to rapidly bring the train up to a kinetic energy or velocity that allows the train to complete the entire ride.

Mechanical systems called pacers are used by ride designers to adjust the speed of roller coaster trains or vehicles for the primary purpose of controlling the energy in the system. The pacer can speed up a slow vehicle or slow down a fast vehicle to provide more consistent and safe performance of the ride system. Pacers can also be used in show portions or sections of the ride course or track to control the speed of a vehicle through a specific scene in order to achieve a desired experience. Mechanical pacers typically include a number of wheels driven by motors at a certain velocity. Tires on the spinning wheels contact the vehicles (e.g., pinch a fin on the bottom of the vehicle), and the physical contact or friction forces cause the vehicle to slow down by removing kinetic energy or speed up by adding kinetic energy (e.g., slow to a speed or velocity in a range at or approaching the velocity of spinning wheels or speed up). In some cases, potential or kinetic energy is added after the mechanical pacer so that the train can complete the course. Potential energy may be provided by again mechanically lifting the train up a second lift hill or kinetic energy may be added through re-launching such as by using a LIM or LSM to capture the train and then apply a magnetic force to the train in the direction it is traveling to accelerate the vehicle to a desired launch speed.

While the train of vehicles generally will slow down or speed up to a velocity at or near the velocity of the spinning wheels, there are a number of problems with using mechanical pacers for rides that include a show portion. Mechanical pacers rely on physical contact, such as between spinning tires (e.g., rubber tires or the like) and a metal fin, to slow or speed up the vehicles, and the contact causes wear that leads to ongoing maintenance including part replacement. This increases costs associated with using a mechanical pacer as its life cycle is reduced especially on rides that experience a high duty cycle (e.g., many cars per hour). The wear also results in the performance of the mechanical pacer varying over time, which causes the performance of the pacer to change such that vehicles may be slowed or sped up less as the pacer experiences wear causing the velocity to be higher or lower than desired during a show portion of a ride. Mechanical pacers also require a large space for mounting of the motors, wheels, and other components. Further, maintenance of a particular pacer unit may require that the unit be lowered into a pit provided under the ride, and such pits also are costly to build and use valuable real estate in the design of a ride. Further, mechanical pacers are typically only useful in relatively long flat and straight sections of track that allow for the fin and friction wheels to properly engage and allow for the large size of the pacer units. Hence, the use of mechanical pacers reduces the freedom of a ride designer because show portions can typically only be provided in straight portions of the ride, and the ride designer also has to build long straight sections of track into the ride rather than providing a ride just with curves or with more curves, which may be desirable for creating unique ride experiences and is also useful for fully utilizing available space or real estate.

Additionally, mechanical pacers operate at one speed with each contacting tire being spun at the same rate, but the vehicles enter the mechanical pacers at a range of speeds. On a roller coaster ride, there are often a number of trains that are run sequentially but spaced apart. While following the same course, each of these trains (e.g., set of cars or vehicles) likely will complete the course in a different amount of time due to differences in the vehicles and due to varying weight of the passengers. Further, the same train typically will likely travel at different velocities each time it travels through the ride due to changes in the passenger make up and other variables. As can be seen, parameters such as temperature, wheel and track wear, train weight, passenger weight, wind, rain, and the like can alter the speed at which a train proceeds through a roller coaster coarse, and as a result, the speed at which the train enters the mechanical pacer varies. For example, a mechanical pacer relies wholly on friction to adjust a speed of a train, and the ride may actually have to be shutdown during periods of rain as the friction is reduced below a minimum value, and the ability of the mechanical pacer to accurately control speed is significantly reduced as the friction applied varies from its design value. The mechanical pacer, however, continues to operate at its one set pace or operating speed as it is essentially a dumb system with a single setting, and this results in a range of train speeds being produced by the mechanical pacer as trains with higher entry velocities exiting at higher velocities than trains with lower entry velocities. As a result, the show experience of the passengers is not consistent and may be different each time a passenger gets on a ride.

Hence, there remains a need for improved pacers for controlling the speed of vehicles or cars of amusement park rides such as roller coasters. Preferably, such pacers would be effective for controlling the speed/energy of vehicles throughout the ride cycle as well as in specific show portions of the ride within an acceptable range about a goal velocity or show design velocity while being relatively inexpensive to implement and maintain. Additionally, it is desirable that the pacer be useful in applications for which mechanical pacers are not well suited such as in sloped and curved sections of track such that the show portions of a ride are not limited to flat, straight sections.

SUMMARY OF THE INVENTION

The present invention addresses the above problems by providing magnetic pacer assemblies and methods for use in amusement park rides and other vehicle movement applications to provide accurate and touch less control of a vehicle's speed. For example, many amusement park rides are designed to include a thrill portion and a show portion. The magnetic pacer assemblies would be used to adjust speed of a vehicle by determining a velocity of the vehicle, comparing the velocity to a desired velocity (or velocity range), determining a thrust to decelerate or to accelerate the vehicle, and operating a magnetic thruster or propulsion device such as one or more linear synchronous motors (LSMs) to generate a magnetic force that is applied to a magnet array provided on the vehicle. In this manner, the magnetic pacer assembly acts as an intelligent pacer that dynamically controls the speed of a vehicle in a section of track in order to ensure proper system performance or within a show portion of a ride so as to allow multi-media show elements to be synchronized closely with the traveling vehicle.

In contrast to launch devices that apply full thrust in a single direction, the magnetic pacer assemblies of the invention generally apply discrete magnetic forces to a vehicle in either direction as needed as it travels over or adjacent a magnetic thruster to try to slow or speed a vehicle whereas launch devices rapidly propel a fully captured or controlled vehicle rapidly to impart kinetic energy to the vehicle. The pacers of the invention may provide feedback control over the length of the pacer by taking additional velocity measurements and applying additional deceleration or acceleration magnetic forces to the vehicle's magnet array, and the additional forces may be in the same or a different direction than initial or previously-applied forces (e.g., a vehicle that is initially slowed may later have to be accelerated to remain within a desired velocity range). In some embodiments, the use of the pacer is to control the energy of individual vehicles and to ensure consistent, safe, and reliable performance of a ride system as a whole. For example, a vehicle moving too slowly may not make it over a steep hill while a vehicle moving too fast could damage brakes or other equipment. The pacers described herein are useful for controlling vehicle energy such as by tuning the vehicle speed, such as on long coasters, to ensure the ride system and its vehicles operate in an expected way or at a nominal velocity/energy baseline. Another use of the pacers is to control the speed of one or more vehicles in a show scene or show portion of the track to provide a desired guest experience (e.g., pace the vehicles to suit a displayed show scene that may include 2D and 3D multimedia).

More particularly, a method is provided for pacing a vehicle, such as a roller coaster train or cars of such a train or other vehicles used in amusement park rides. The method includes providing a controller such as hardware and software components that have stored speed settings in memory for the vehicle within a portion of the ride, e.g., upper and lower speed limits for a show portion of a ride or engineered speed targets at various locations of the ride for which the system has been designed. A magnetic thruster is positioned near the portion of the ride, and the thruster typically includes one or more position sensors that are linked to the controllers. The method continues with a signal or signals being sent from the sensors to the controller, and the controller responding by determining a velocity of the vehicle as it travels along a direction of travel in the portion of ride for which pacing is desired. The controller further acts to compare the determined vehicle velocity with the stored speed settings (such as with upper and lower bounds or trigger points defining an acceptable velocity range for the ride portion). The method continues with determining a magnetic force to apply to the vehicle based on the comparing. Then, the magnetic thruster is selectively operated (e.g., not continuously operated as is the case with mechanical pacers) to generate the selected magnetic force, which acts upon a magnet array on the vehicle to pace the vehicle.

In some embodiments, the determination of the magnetic forces to apply includes determining which direction the force should be applied relative to the direction of travel of the vehicle such that the applied magnetic force is a decelerating force or an accelerating force applied to the vehicle. For example, the magnetic force may be decelerating (with its direction being opposite or at least transverse to the direction of travel to repel or resist the vehicle) when the determined velocity exceeds an upper speed bound or trigger defined in the stored speed parameters. In contrast, the determined velocity may be less than a lower speed bound or trigger, and the magnetic force may then be selected to propel or accelerate the vehicle along its direction of travel.

In some cases, the magnetic thruster is one or more linear synchronous motor (LSM) and the operating of the thruster or LSM comprises operating the LSM such that it applies a force or generates a field that is useful for decelerating or accelerating the vehicle in the portion of the ride based on the determined velocity. The use of an LSM or other magnetic thruster may be desirable such that when the vehicle travels upon a track (such as a roller coaster) the track may be curved and/or inclined in the portion of the ride rather than having to be flat and straight as is the case with mechanical pacers. The magnetic thrusters typically do not capture the vehicle (i.e., remove all of their kinetic energy or momentum). In this regard, the method may be performed such that the vehicle is coasting at the determined velocity as it enters the portion of the ride (or soon thereafter) along the direction of travel, and after the magnetic thruster applies the magnetic force the vehicle continues to coast at a velocity that is greater than zero and, preferably, that is within a velocity range defined by the stored speed settings for the ride portion.

The determination of velocity of the vehicle may be determined in a repeated manner, and the controller may determine that based on a comparison of these additional velocity measurements that additional magnetic forces should be applied to pace the vehicle. Hence, additional magnetic forces may be generated using the magnetic thruster to maintain the vehicle within a velocity range defined in the speed settings and at least some of these magnetic forces will likely differ in magnitude and/or direction from the originally-applied magnetic force (e.g., the first force may act to decelerate the vehicle while a second force may act to accelerate the vehicle when the vehicle slows to a velocity out of a desired range). In this manner, the magnetic thruster operates to achieve its function or goal of achieving and maintaining a desired vehicle speed.

DETAILED DESCRIPTION OF THE PREFERRED EMBODIMENTS

Figure 1:
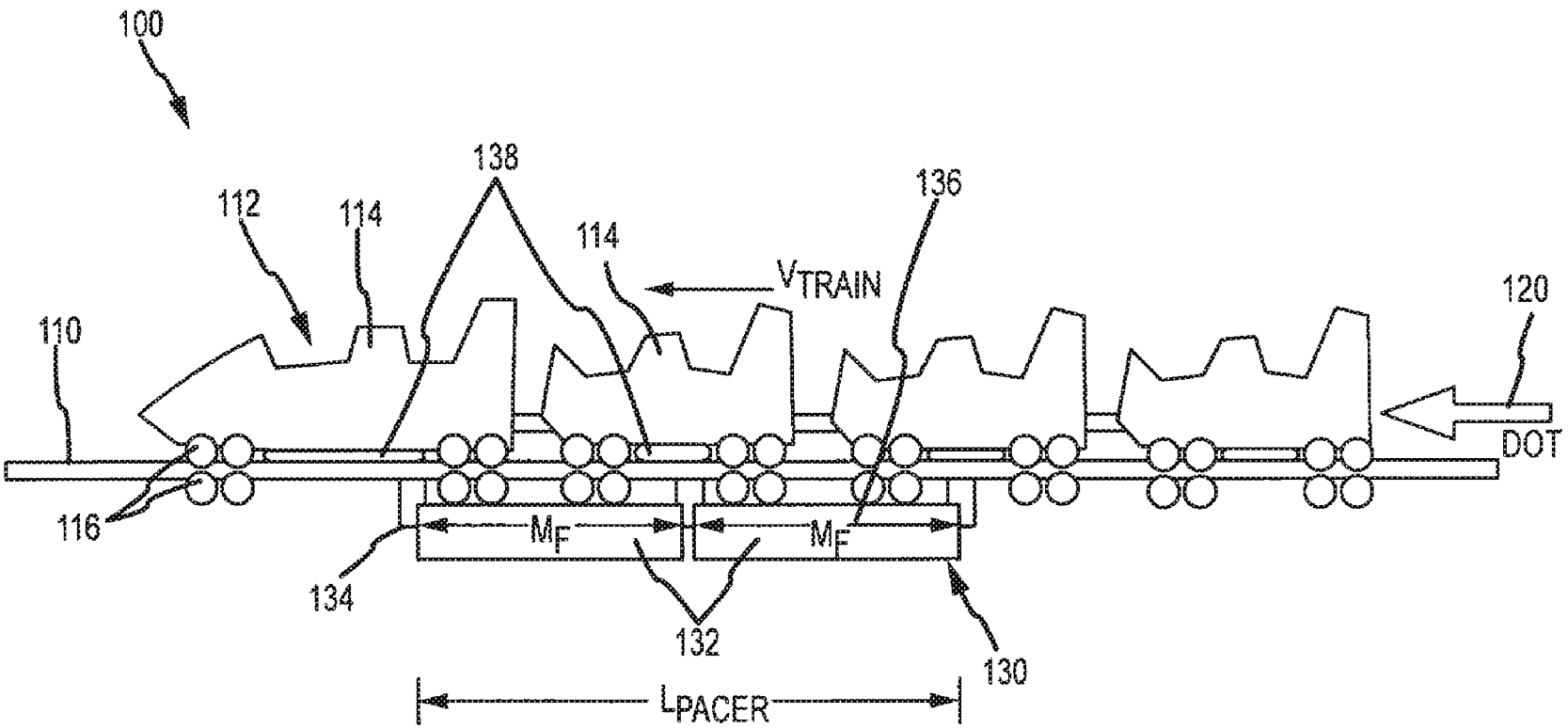
FIG. 1 is a simplified side view of an amusement park ride such as a roller coaster illustrating use of a magnetic pacer assembly to adjust speed or velocity in a pacer section (or show section) of the track.

Briefly, embodiments of the present invention are directed to methods and systems for pacing or controlling the speed of vehicles or cars in amusement park rides. Particularly, the present invention provides a magnetic pacer assembly and methods of using such an assembly to provide a non-contact or "touch less" mechanism for selectively and accurately applying a thrust to slow or to accelerate a vehicle or car during operation of a ride to achieve a speed or velocity within an acceptable range (e.g., an acceptable velocity band for a ride such as for a show portion of the ride). Generally, magnetic forces are applied in or along the direction of travel ("DOT") such as with a magnetic thruster (e.g., a LSM, a LIM, or the like) to propel the car or opposite the DOT to resist its travel and reduce its momentum.

For example, the design of a roller coaster involves the need to adjust the train speed as it moves about the track. There are speed variations due to many factors including train weight, passenger loading, temperature, wheel wear, and the like. To ensure the coaster operates within the design parameters, these speed variations preferably are corrected or controlled to allow for optimum vehicle spacing and performance. Additionally, many roller coasters are designed to include a show portion (or dark ride portion) in which visual, auditory, and other effects can be presented such as with a multi-media show system to enhance the riders' experiences such as by providing greater ride variation through storytelling and other techniques. Embodiments of the invention use a linear synchronous motor (LSM) or other magnetic thruster as part of a magnetic pacer assembly to provide speed corrections in the show or flat portions of the ride, and these speed controls include determining the initial speed or velocity of the train or vehicles of a ride as it enters the pacer area of the ride (e.g., enters a flat portion of the track or another portion of the track near a show system). Based on this determined speed, resistive or propulsive forces are applied to magnets, magnet arrays, or reaction plates mounted on the vehicles with magnetic thrusters (or magnetic propulsion devices) positioned adjacent to the track in the pacer area (e.g., off-board on the track) that are controlled and powered to adjust the direction of the magnetic field, the timing of the application of such magnetic forces (attracting or repulsing), and, in some cases, the magnitude of the generated magnetic fields.

Prior pacers for amusement park rides were mechanical systems that relied upon contact and friction forces to adjust the speed for roller coaster trains and other ride vehicles. Mechanical pacers typically include a set of wheels on the track that have to engage or pinch a fin on the vehicle to slow the vehicle. The wheels are spun at a fixed velocity, and tires on the wheels contact the fin (e.g., tires formed of rubber, plastic, or other material for use in braking). In the pacer, the vehicles are slowed toward the speed at which the wheels are rotated. However, the mechanical systems are imprecise and are not able to control or adjust the speed to a very tight velocity range or band, which may be preferred for many show designs such as video that is adapted such as through distortion to match the design or goal velocity of a train or vehicle on the corresponding show portion of the track. The effectiveness of the mechanical system can vary with wear of the mechanical components such as the tires and wheel bearing and can vary with weather such as when friction is reduced during rain. Further, mechanical pacers are only useful in flat sections of the track where full engagement between the wheels and the fins is possible and in straight sections of the track as their large size limits mounting in tight corners.

In contrast, and as discussed in detail below, the magnetic pacer assemblies of the present invention provide a touch free and low maintenance system for controlling a roller coaster train or ride vehicle's speed. Portions of these assemblies can be fitted in flat stretches of track and also in flat and compound curves and sloped sections of track, which allows ride designers more freedom in creating interesting tracks and rides with unique mixes of thrill and show. With regard to operating costs, mechanical pacers have motors that run continuously at a particular speed whereas the magnetic thrusters of embodiments of the invention are typically only energized as needed to adjust speed and, for this and other reasons, are more energy efficient, have few moving parts, and require less frequent maintenance.

FIG. 1 illustrates an embodiment of an amusement park ride control system 100 configured for controlling a speed of vehicles or cars of a ride. Particularly, the control system 100 is designed to adjust a velocity of vehicles in a portion of a track 110 that is in proximity to a pacer of the present invention. For example, the control system 100 may utilize a magnetic pacer assembly 130 to maintain the train 112 at a velocity, $V_{train}$ that is within an acceptable speed or velocity range or band, e.g., at velocities in a relatively tight band about a design or goal velocity for a particular show effect. As shown, the train 112 may be a roller coaster train with a number of vehicles or cars 114 riding on track 110 via wheels or bogies 116. The train 112 is traveling in a particular DOT 120 at a velocity, $V_{train}$. Prior to the section of track 110 shown in FIG. 1, the train 112 may have been lifted up a lift hill and released and/or launched to be given a particular amount of potential and/or kinetic energy, and the velocity, $V_{train}$, is based on the magnitude of this energy as well as other parameters such as the weight of the vehicles 114, the weight of passengers in the vehicles 114, the configuration of the track 110, operating conditions of the vehicles 114 and track 110, and the like. Hence, the velocity, $V_{train}$, of the train 112 as it enters the portion shown (e.g., a show portion) likely will fall within a relatively large range, and it may be desirable to adjust the velocity, $V_{train}$, so that it matches a goal or design velocity or at least is within a velocity band about such a design velocity.

To provide speed control, the system 100 includes a magnetic pacer assembly 130. The magnetic pacer assembly 130 includes magnet arrays 138 mounted to the vehicles 114 such as on the bottom frame of at least the lead car or cars 114, on every other car 114, or, in some cases, on every car 114 of the train 112. The magnet arrays 138 may include one permanent magnet or, more commonly, multiple magnets arranged linearly along a portion of the vehicle 114 so as to be near but spaced apart from the track (e.g., no contact). The magnetic array 138 provides the reaction surface for magnetic forces that are generated selectively (e.g., not typically continuously) by one or more magnetic thrusters 132, which are attached via mounts 134 to the track 110 or otherwise positioned near the track 110.

The magnetic thrusters 132 are controlled and powered to generate magnetic forces 136 either opposite the DOT 120 to decelerate the train 112 or in the DOT 120 to propel the train 112. The magnetic thrusters 132 are mounted, in the illustrated embodiment, to the track 110 such that they are provided in a plane that is substantially parallel to a plane containing the magnet arrays 138 on the vehicles 114, and the magnetic thrusters 132 are typically also mounted via mounts 134 to be proximate to the magnet arrays 138 as the vehicles 114 pass over the thrusters 132. In some cases, the thrusters 132 will hang below the track 110 as shown to be below the wheels 116 riding on the bottom of the track 110. In other cases, the thrusters 132 may be mounted to be inside the wheels 116 and may be between the tracks 110 or even extend above the tracks 110 toward the arrays 138 but still leaving a space or gap between the thrusters 132 and the magnet arrays 138 (and other components of the vehicles 114).

The magnetic thrusters 132 or other components (not shown in FIG. 1) of the assembly 130 are used to measure vehicle speed $V_{train}$, as the vehicles 114 initially begin to pass over the thrusters 132 to determine an initial speed and typically at other points along the length of the pacer, $L_{pacer}$. The measured speed, $V_{train}$, is compared by the assembly 130 (such as with a processor and software not shown in FIG. 1) with a desired speed or velocity goal for the portion of the track 110 proximate to the pacer assembly 130. When the measured velocity, $V_{train}$, is less than a trigger value (e.g., a velocity at a preset amount below the goal velocity) all or select ones of the thrusters 132 are controlled and powered to apply a magnetic force 136 to the magnetic arrays 138 to propel the train 112 down the track 110 in the DOT 120 (e.g., to accelerate the train 112). Similarly, when the measured velocity, $V_{train}$, is greater than a trigger value (e.g., a velocity exceeding a preset amount greater than the goal velocity) all or select ones of the thrusters 132 are controlled and powered to apply a resistive magnetic force 136 on the magnetic arrays 138 to slow the train 112 as it travels in the DOT 120 (e.g., to decelerate the train 112 by removing some kinetic energy or reducing the trains 120 momentum).

The train 112 is typically not captured such that the pacer assembly 130 has to provide all motive force but instead the magnetic forces 136 are applied in a discrete manner to increase or decrease the kinetic energy of the train 112 as it travels over the magnetic thrusters 132, which differs from launch systems in which a vehicle or train is fully captured by the launch mechanism and then quickly accelerated. Another difference with launch systems, as explained with reference to FIG. 6 is that the pacer assembly 130 in some embodiments operates to determine the train velocity, $V_{train}$, such as at one or more points along the thrusters 132 and/or along train 112 such that the force 136 applied by the thrusters 132 can be dynamically controlled or adjusted. For example, the magnetic thrusters 132 may be operated initially to apply a resistive magnetic force 136 when the train 112 is near the thrusters 132 because it is traveling above the goal velocity but a later measured velocity, $V_{train}$, such as of later cars 114 may indicate the velocity, $W_{train}$, has dropped below the goal velocity and even below a minimum trigger velocity, and the thrusters 132 may be operated to apply the thrust 136 in the opposite direct (i.e., in the direction of or parallel to the DOT 120) to accelerate the train 112 toward the target or goal velocity. Additionally, there may be a shut off velocity in which a propelling or braking magnetic force 136 is removed by reducing or turning off power to the thrusters 132. For example, the measured velocity, $V_{train}$, may be reduced to a velocity at or slightly above a target or goal velocity for the track 110 (or show portion of track 110) and the force 136 may be removed to again allow the train 112 to coast. The specific control of the magnetic thrusters 132 is discussed in more detail with reference to FIGS. 3-5.

Figure 2:
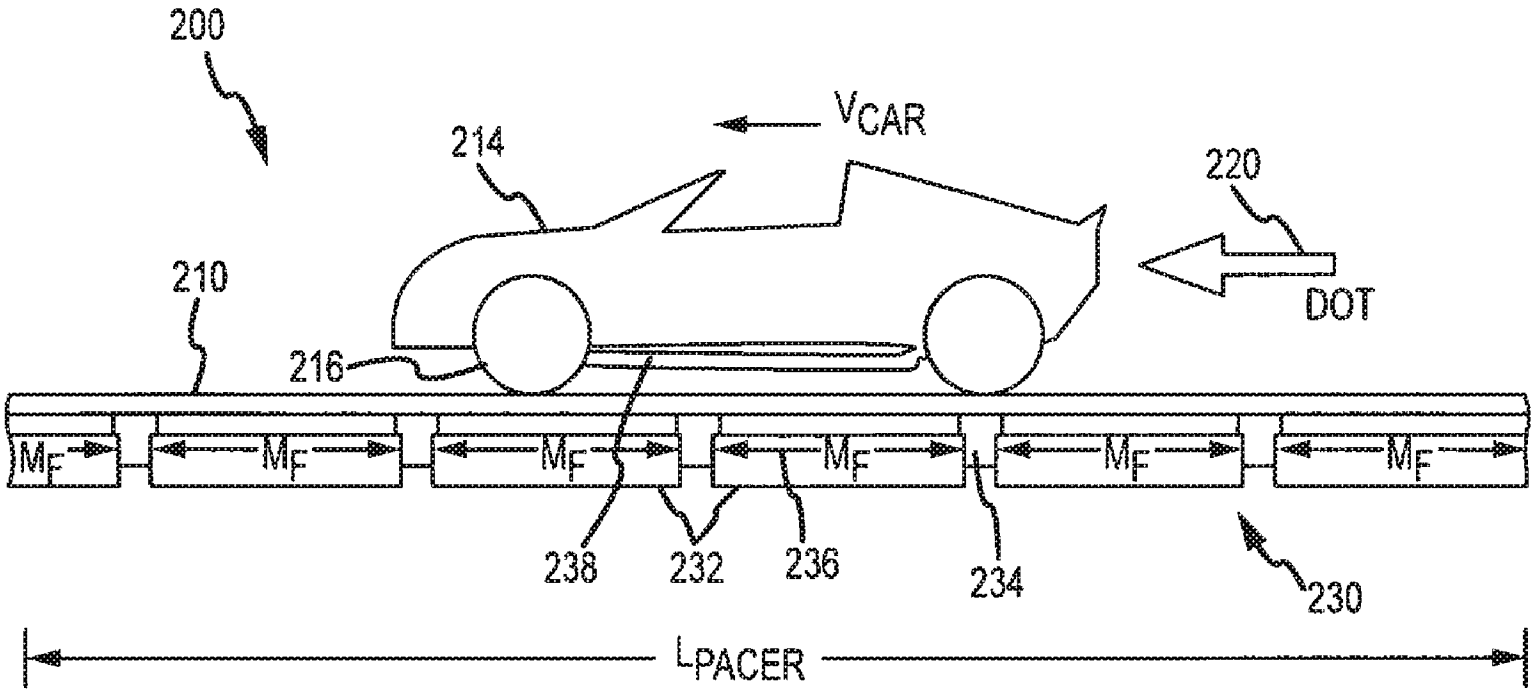
FIG. 2 illustrates a side view similar to that of FIG. 1 showing another amusement park ride in which a magnetic pacer assembly is used to adjust speed or velocity or propel a ride car or vehicle along the entire or a portion of the track at one or more ride velocities.

In some embodiments, the magnetic pacer assemblies of the invention may be utilized to power a vehicle or car in larger portions of the ride. For example, it may be desirable for an amusement park ride control system 200 to be provided as shown in FIG. 2 with a magnetic pacer assembly 230 that is adapted for propelling a car 214 on a track 210 at a velocity, $V_{car}$. As with the train 112, the car 214 is propelled by magnetic forces along a DOT 220 such that it rolls on wheels 216 contacting the surface of the track 210. The car velocity, $V_{car}$, may be varied at different locations or portions of the track 210 to provide a desired experience such as fast during a thrill portion and slow in a story or show portion. In this embodiment, a magnetic pacer assembly 230 is provided that includes a magnet array 238 mounted on the car 214 such as the lower body of the car 214 near the track 210 although the magnet array 238 may be mounted in other locations such as on top of or on the side(s) of the vehicle 214 (e.g., with thrusters then provided along the track 210 in positions adjacent or proximate to a car 214 on the track 210). The assembly 230 includes a plurality of magnetic thrusters 232 attached via mounts 234 to the track 210 (or otherwise positioned near the track 210 or car 214 on track 210) that each are selectively operable to propel the vehicle 214 along the DOT 220 at one or move velocities, $V_{car}$. The thrusters 232 may be similar in configuration or some of the thrusters may differ such as some being longer or shaped for curved or sloped sections or some differing in capacity (e.g., differing sections of track 210 may require more force 236 to propel the vehicle such as in upward slopes and some less force 236 such as an inclined portion). Operation of the magnetic pacer assembly 230 as with assembly 130 generally involves determining the velocity, $V_{car}$, of the car 214 as it passes near a thruster 232 and then operating the thruster 232 to push the car 214 on the track 210 along the DOT 220, to apply no force 236 to allow the car 214 to coast, or to apply a resistive magnetic force 236 in a direction generally opposite the DOT 220 to slow the vehicle 214 or drive it backwards.

In general, each of the magnetic thrusters 132 and 232 is formed using an electromagnet or series of electromagnets that are selectively powered to develop the magnetic force 136, 236 that controls the speed of the vehicles of a ride. Magnetic-based thrusters 132, 232 are desirable for a number of reasons including reduced maintenance as the propulsion does not require contact and has significantly fewer/no moving, wear, or replacement parts, reduced space requirements as the systems are much smaller in size, ability to use in sloped and corners of a track since contact is not required and because of their size and somewhat flexible geometrical configuration, and control features. The control features allow the forces 136, 236 to be rapidly changed from one direction to another (such as by switching polarity) to decelerate a vehicle or to accelerate a vehicle whereas mechanical pacers are run in one direction. The control features also typically allow the thrusters 132, 232 to only be operated when needed such as when a vehicle is adjacent the thruster 132, 232 and a speed determination indicates that the velocity needs to be modified (e.g., the car velocity is out of a design speed band or is greater or less than trigger values for operating the thrusters 132, 232). In some embodiments, the amount of force 136, 236 is also variable such that a thruster 132, 232 can be used to apply a force 136, 236 of a magnitude that is selected based on the determined speed of the vehicle such as a greater force when the vehicle significantly differs from a velocity target or a lesser force when the vehicle only slightly differs from the desired velocity range.

The magnet array and magnetic thruster may both vary significantly to practice the invention, and it is believed that those skilled in the art will readily understand how to implement these components of the invention. For example, in some cases, the magnetic thrusters 132, 232 are linear induction motors (LIMs) or linear synchronous motors (LSMs) because both of these magnetic thrusting technologies are well developed and understood and both well-suited for providing the level of control over magnetic thrust forces applied to an amusement park ride vehicle as described herein. A linear motor such as an LIM or LSM is generally an AC electric motor with a linear or unrolled stator so that instead of producing a torque it produces a linear force (such as forces 136, 236) along its length (e.g., $L_{spacer}$) that is proportional to the current and the magnetic field. LIMs are thought of as high-acceleration motors and have an active three-phase winding on one side of the air gap (e.g., the thruster 132, 232) and a passive conductor plate on the other side (e.g. metal fins used for magnet array 138, 238). LSMs are, in contrast, considered low-acceleration, high speed and power motors that have an active winding on one side of the air gap (e.g., the thruster 132, 232) and an array of alternate-pole magnets (e.g., the magnet array 138, 238, which may be permanent magnets or energized magnets) on the other side of the air gap.

While LIMs and other magnetic thrusters may be utilized, the following discussion provides more detail of use of LSMs in the magnetic pacer assemblies 130, 230 for ease of explanation (with much of the control detail being equally applicable to LIMs) and because it is presently believed that LSMs present a desirable implementation. LSMs are synchronized in that the magnetic thrusters 132, 232 are energized with a synchronized pulse such that its electromagnets are turned on and off in sequence to decelerate or accelerate (e.g., generate magnetic forces 136, 236) when the armature magnets of the thrusters 132, 232 (e.g., the long stator in the guideway off board) are properly positioned between or offset from like magnetic poles in the magnet arrays 138, 238 (e.g., to be attracted to opposite polarity magnets or to repel like polarity magnets as desired to propel or resist travel). In other words, synchronous means the speed of the vehicle typically is related to the frequency of the motor excitation of the thrusters 132, 232, and the currents in the stator coils (not shown) of the thrusters 132, 232 are synchronized with the vehicle or car's position and its velocity. In operation, the thrusters 132, 232 create a moving magnetic field in the vicinity of the vehicle that travels in a direction generally along or coinciding with the DOT 130, 230 or opposite the DOT 130, 230 to achieve a desired effect.

Embodiments of the magnetic pacer assemblies 130, 230 may include components presently distributed or on the market. For example, the thrusters 132, 232 may be LSM such as an LSM available from companies such as MagneMotion, Inc. of Acton, Massachusetts, USA (e.g., an LSM from the QuickStick™ line of LSMs or LSM systems). Similarly, the power and control components (such as position sensing devices) may be provided by companies in the magnetic drive industry such as MagneMotion, Inc., but, of course, these components would be configured to operate according to the control processes of the present invention and for use in the particular arrangements taught herein for adjusting speed of amusement park rides (e.g., without full capture as in the case of a launch and, in some cases, incrementally based on a measured velocity that is compared with a goal velocity or a bounding range about such goal velocity). Some available LSM products are provided in a package that can be used as or as part of the thrusters of the invention and may include a stator package (e.g., about 1 meter or more in length) that includes the equipment necessary to generate a magnetic field and to measure the speed and position of a vehicle. These stator packages can be installed on or near a track or guideway end-to-end. In some cases, each stator package may be provided with an external power source and may be connected via a serial communications line to an upstream and/or downstream position of the stator package.

For example, a series of magnetic thrusters (e.g., LSMs, LIMs, or the like) may be powered by a power supply via a power cable attached to the thrusters and the power may be provided in a controlled manner (e.g., timing of on/off based on determined velocities of adjacent vehicle, direction of magnetic field selected based on velocity, and, in some cases, amount of power controlled based on variance from a target or trigger velocity value). A communications line typically will also be provided to provide control signals from a controller (e.g., a combination of software and hardware such as a CPU, memory, and the like) and to provide sensor signals from sensors (e.g., position sensors) provided in or near the thrusters to the controller. The controller may use the position signals to synchronize operation of the thruster, and the controller uses the position signals to determine the velocity of the vehicle. This determined velocity is then compared to a target velocity and/or against minimum and maximum trigger values bounding this target velocity to determine whether a magnetic force should be applied to the vehicle (i.e., whether the thruster should be operated to adjust the vehicle velocity) and, if so, which direction and, in some cases, which magnitude to apply the force (i.e., as a propulsion force or as a resistive or braking force).

Proper control of the pacer assembly 130, 230 can be achieved with position sensing equipment provided as part of the thrusters 132, 232 and preferably the sensing and signal transmission systems will have high precision and reliability as synchronization is essential to an LSM. Control may be achieved in part with position sensing devices that when a vehicle passes over or near provide a signal, such as an electrical pulse, to position and/or velocity control modules of a control processor of the magnetic pacer assembly. The position sensor may be any of a number of sensors useful for determining position such as those based on electrical current, optics, magnetic flux sensor, radio signal sensor, or even mechanical-based position sensors. For example, position sensing may be accurately performed (and, in some cases, integrated into the magnetic thruster such as an LSM module) as taught in one of the following, each of which are incorporated herein in their entirety: U.S. Pat. No. 6,011,508 to Perreault; U.S. Pat. No. 6,983,701 to Thornton; U.S. Pat. No. 6,781,524 to Clark; U.S. Pat. No. 4,381,478 to Saijo; U.S. Pat. No. 5,605,100 to Morris; and U.S. Pat. No. 6,499,701 to Thornton. In addition to position sensing, these issued patents teach communication and control processes and components that may be useful in part or in whole in some embodiments of the present invention when adapted for use in the systems and control processes taught herein, and these references are incorporated herein for their teaching regarding control and communications within magnetic drive systems such systems using LIMs, LSMs, and the like for propulsion systems.

Figure 3:
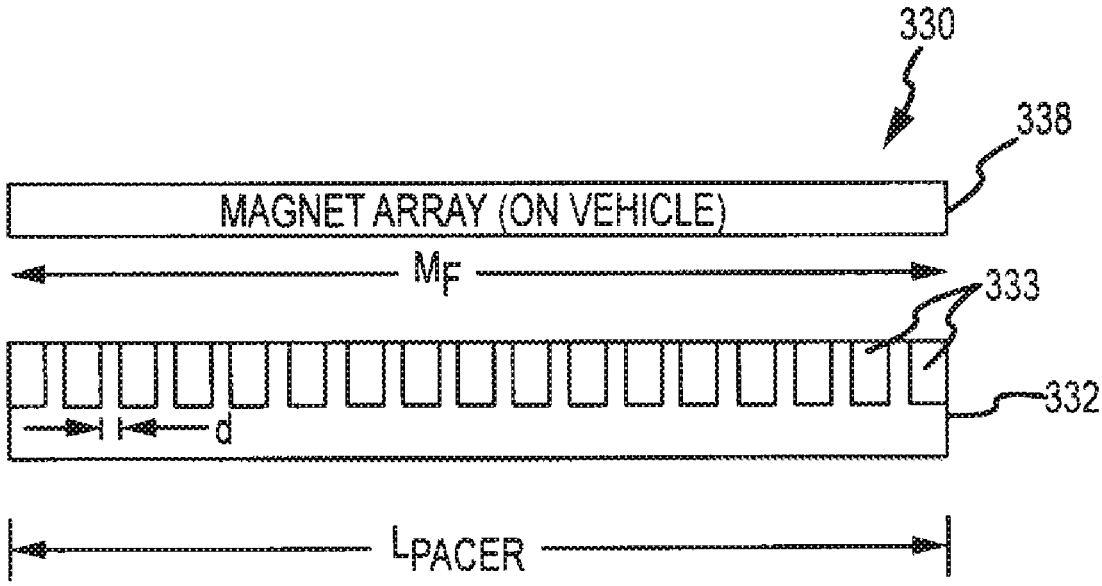
FIG. 3 illustrates a side view of a magnetic pacer assembly illustrating use of sensors for use in determining position and, typically, velocity of magnet array passing adjacent the magnetic thruster, e.g., speed of a roller coaster train passing over the magnet array.

FIG. 3 illustrates a portion of a magnetic pacer assembly 330 (such as may be used for assemblies 130, 230) showing one approach to accurately sensing position of a vehicle as it passes over or proximate to the magnetic thruster or propulsion device. As shown, a magnet array 338 is positioned adjacent to a magnetic thruster or propulsion device 332 such as when a vehicle or coaster train passes over a portion of track where the thruster 332 is positioned. In operation, it is desirable for the assembly 330 to function to determine quickly and accurately the initial or incoming velocity of the vehicle, and this can be done by determining the position of one or more magnets in the array 332 by two or more position sensors 333 provided in the thruster 332 (i.e., the speed of the array 338 will be the same as the vehicle to which it is attached).

As shown, a series of position sensors 333 are provided as an integral part of the thruster 332 but may also be positioned near the magnetic propulsive device 332. Typically, it is desirable for the sensors 333 to be positioned adjacent the thruster 332 such that the determined velocity for the vehicle corresponds to the section of track where the thruster 332 is positioned so that the thruster 332 can be controlled to adjust the velocity of the vehicle as it passes over the thruster 332. The sensors 333 are shown to be arranged along the entire length, $L_{pacer}$, of the thruster 332 in this embodiment and to be spaced apart by a fixed, known spacing, d. In other embodiments, the number of sensors 333 may vary to practice the invention but typically will range from 2 to 5 or more, and in cases where fewer sensors are utilized these may be placed closer to the leading edge of the thruster 332 to allow the thruster 332 to be operated in response to a velocity determination while the vehicle is adjacent to the thruster 332 (although in many cases the thruster 332 will be operated to slow later vehicles in a train such as in the case of a roller coaster). The velocity of the vehicle carrying the magnet array 338 can be determined from signals received from two or more sensors 333 based upon the time differential between receipt of the two or more signals. The use of more than 2 sensors 333 is desirable in some cases to allow the velocity to be determined more than once per thruster 332, as this allows control or operation of the thruster 332 more precisely.

For example, electrical pulses or position signals may be provided to a controller for a first pair of leading edge sensors, and the controller may determine the vehicle velocity exceeds a desired value which results in the thruster 332 being powered to apply a braking or resistive force (e.g., a magnetic field opposing travel of the vehicle or opposite the DOT of the vehicle). If no additional sensors 333 were provided, the thruster 332 would continue to be operated to brake the vehicle until or unless a later magnet in the array 338 was sensed to be traveling at an acceptable velocity. The use of multiple sensors 333 allows the velocity of the vehicle carrying the array 338 to be determined more than once as the array 338 passes along the length, $L_{pacer}$, of the thruster 332, and the plurality of measurements of velocity can be used to repeatedly operate the thruster (or continue to power the thruster) 332 such as to turn off the thruster when a trigger value or goal value for velocity is reached or to apply a magnetic force, $M_F$, in the opposite direction when the velocity falls below or exceeds a particular velocity value.

Figure 4:
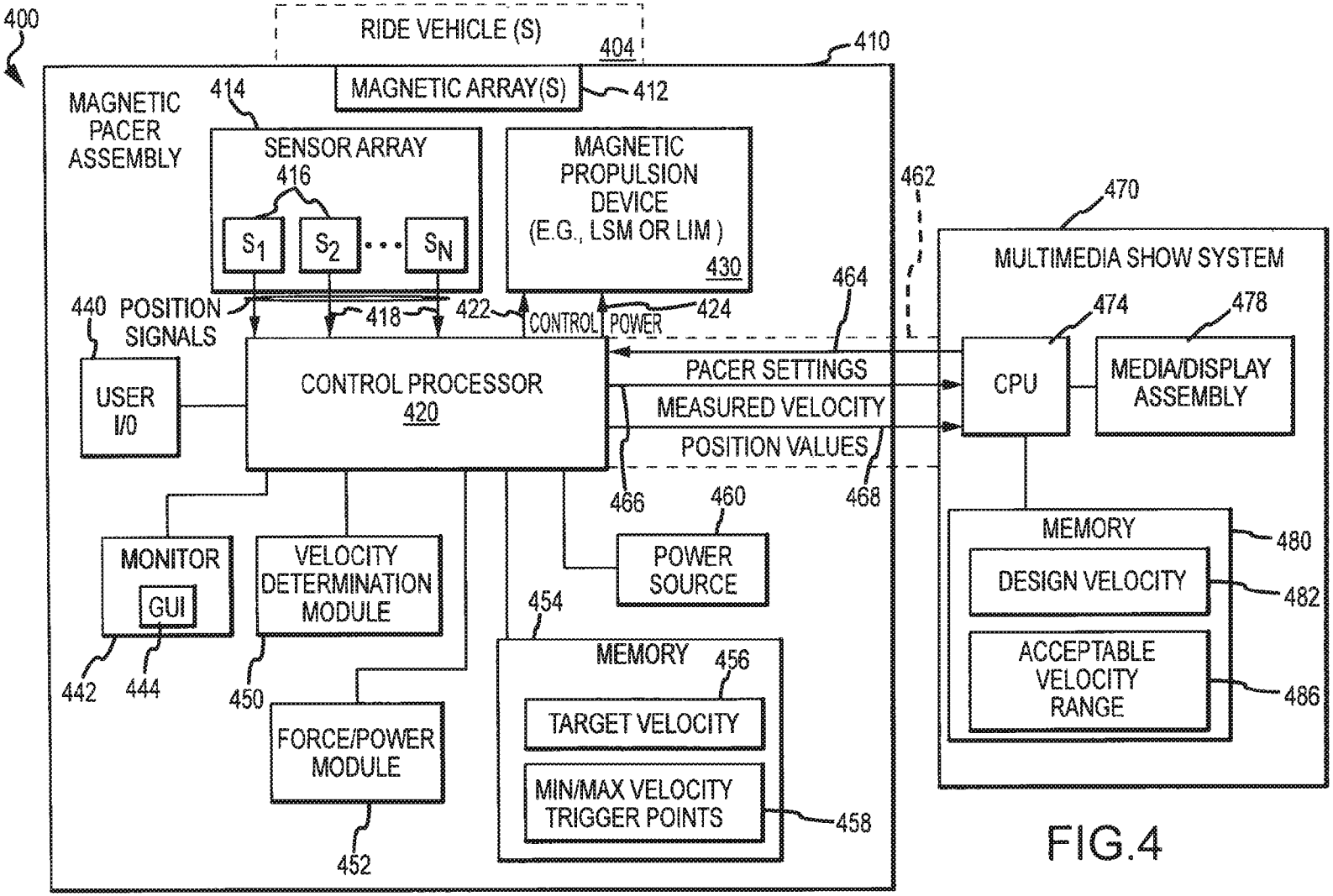
FIG. 4 is a functional block diagram for a portion of an amusement park ride control system that includes a magnetic pacer assembly for controlling speed of ride vehicles such as to support a multimedia show portion of the ride (or to otherwise set a speed of the vehicles at a particular track location.

FIG. 4 illustrates an amusement park ride control system 400 in functional block form that includes a magnetic pacer assembly 410 for pacing the speed of a ride vehicle or vehicles 404. Typically, the pacer assembly 410 is used to adjust the speed of the vehicle 404 as it travels over a particular portion of a ride track that is considered a show or story portion in which a multimedia show system 470 is presenting a show or display. To this end, the multimedia show system 470 may include a media/display assembly 478 (e.g., video, audio, animatronics, and the like) that is operated by a processor or controller 474 in a manner that is synchronized with the travel of the ride vehicle 404 through the show portion of the ride track and, in some cases, in a manner that is synchronized with the velocity of the ride vehicle 404. In other words, the media/display assembly 478 may be operated when a vehicle 404 is sensed to be in the show portion and the media (such as a video or animatronic function) may be timed based on a design, goal, or target velocity for the vehicle. This design velocity 482 may be stored in memory 480 of the show system 470 along with an acceptable velocity range 486. These values may be transferred or communicated as pacer settings 464 over a digital communication network or lines 462 to the magnetic pacer assembly 410.

The magnetic pacer assembly 410 includes the controller or control processor 420 that functions to process the pacer settings 464 and to store in memory 454 a target or goal velocity 456 for a ride vehicle 404 in a particular show portion of the track along with minimum and maximum velocity trigger points 458 (e.g., upper and lower bounds about the target velocity 456 that are used to determine when to operate the thruster and in which direction to provide the magnetic field). The system 400 may comprise a computer or an electronic system configured for processing sensor signals and responding by controlling operation of the pacer assembly 410. The assembly 410 further may include a control module as part of or separate from control processor 420 that may be software, firmware, and/or hardware that controls operation of the assembly 410. The specific computer and electronics hardware and computer software and programming languages implemented to practice the invention is not limiting. Similarly, communications of digital and electronic signals may be performed in any well-known manner such as via the use of serial communication lines or busses, via communications networks such as LAN, WAN, and the like, and in a wired or wireless manner as is known or as may later be developed.

As shown in FIGS. 1-3, the magnetic pacer assembly 410 includes a magnetic array(s) 412 that is positioned on the vehicle 404. A sensor array 414 with a two or more sensors 416 is positioned in the assembly 410 to be proximate a track (not shown) upon which the vehicle 404 travels and to also be proximate or adjacent to the magnetic propulsion device 430. The sensors 416 are linked to the control processor 420 and transmit position signals 418 to the processor 420, which may respond by determining a position of the ride vehicle 404 (e.g., to relay position values 468 to the multimedia show system 470 for use in operating the media/display assembly 478).

More relevant to the present invention, the processor 420 runs a velocity determination module 450 to determine a velocity of the vehicle 404 from two or more of the position signals. For example, the position sensors 416 are used to measure a position of one or magnets in the array 412, and vehicle velocity is derived based on measured position and time (e.g., time for magnet to move between two positions). The control processor 420 then compares this velocity to either or both the target velocity 456 and trigger points 458 (which may be determined based on the target velocity such as tolerance band or the like). Based on this comparison, the control processor 420 determines whether to operate a magnetic propulsion device 430 (such as an LSM) using control signals 422 and/or by providing power 424 to the device 430 from power source 460 (which may be part of assembly 410 as shown or be a separate device). The control by processor 420 includes selecting whether the propulsion device 430 is to apply a resistive or braking force (i.e., when the determined velocity is greater than the target velocity 456 or over a trigger point 458) or to apply a propulsive or accelerating force (i.e., when the determined velocity is less than the target velocity 456 or less than a minimum trigger velocity 458). In some embodiments, the processor 420 may also run a force/power module 452 to determine a power level 424 to provide to the propulsion device 430 to achieve a braking or propulsive force of a particular magnitude (e.g., a maximum force when the differential between measured and target velocity exceeds a particular value and a smaller force at other differentials).

The pacer assembly 410 further includes a user input and output (I/O) 440 (e.g., a mouse, keyboard, touch screen, and the like) allowing a user or operator of the assembly 410 to input information such as to manually adjust the target velocity 456 or to set trigger points 458, to set power levels provided by processor 420, and to request particular displays (such as tables of determined velocities for the ride vehicle 404 and graphs showing determined velocities relative to desired values such as shown in FIG. 6). A monitor 442 is also provided with a display or GUI 444 for showing velocity data, current settings, and the like.

As shown, the multimedia show system 470 operates a media/display assembly 478, and initiation of a display or function may be performed in response to receiving position values 468 from the pacer assembly 410 or from a separate position sensor assembly (not shown). In some embodiments, the CPU 474 also receives a measured velocity 466 for the ride vehicle 404 from the control processor 420 of the pacer assembly 410. The measured velocity may vary along the length of the pacer or propulsion device 430 as discussed with reference to FIGS. 1-3. The CPU 474 may present this information to the media/display assembly 478, which, in turn, may operate based on this real time data. For example, a video image in 2D or 3D may be distorted based on a design velocity 482 such that the image appears non-distorted to passengers of the vehicle 404 traveling past the display assembly 478 at a measured velocity matching this design velocity 482. In some cases, the distortion or other multimedia effect is altered to match the measured velocity 466 of the vehicle 404 such that show system 470 achieves an effect that is finely tuned to the actual velocity of the vehicle 404 rather than merely to a design velocity 482. In other cases, this function is obviated by the tight control provided by the magnetic pacer assembly 410, which in some cases is anticipated to be able to pace the vehicle 404 within a relatively tight set of trigger points or upper and lower bounds (e.g., if a design velocity of 10 meters/second is set by the show system 470, it is expected that the assembly 410 will be able to adjust the measured velocity to within 10 percent of this value and more typically within 5 percent or less of this range). For example, controlled speed scenes may have relatively slow velocities (e.g., to reduce the use of track length and the like), and, as a result, the target velocity may be selected from the range of 1 to 6 feet per second or some other useful range. In this example, it may be useful to maintain the target velocity within a fairly small range such as plus or minus 1 to 2 percent of the target velocity.

In other cases, the multimedia show system 470 may provide the pacer settings 464 in a more dynamic manner. In these cases, the media/display assembly 478 may provide the pacer settings 464 for use by the control processor 420 of the magnet pacer assembly 410 in setting a target velocity 456 and trigger points 458. One example would be a ride that has 2 to 4 or more different scenes that are generated in a display setting or environment along the track near the magnetic pacer assembly 410 and magnetic propulsion device 430. Hence, the media/display assembly 478 may adjust the velocity band (e.g., target velocity 456 and trigger points 458) between ride vehicles 404 to match a next planned show scene. The media/display assembly 478 then operates to display or create the scene matching the newly provided pacer settings 464 when the next ride vehicle(s) 404 travel by the magnetic pacer assembly 410 (as determined by position values 468 or other techniques), and the assembly 410 paces the vehicle 404 based on these dynamic settings. In this manner, for example, a ride may be made more unpredictable as the display may change to encourage repeat rides to see all the scenes, and this process may also be useful when a single stretch of track is passed by a vehicle(s) 404 more than once during a ride.

Figure 5:
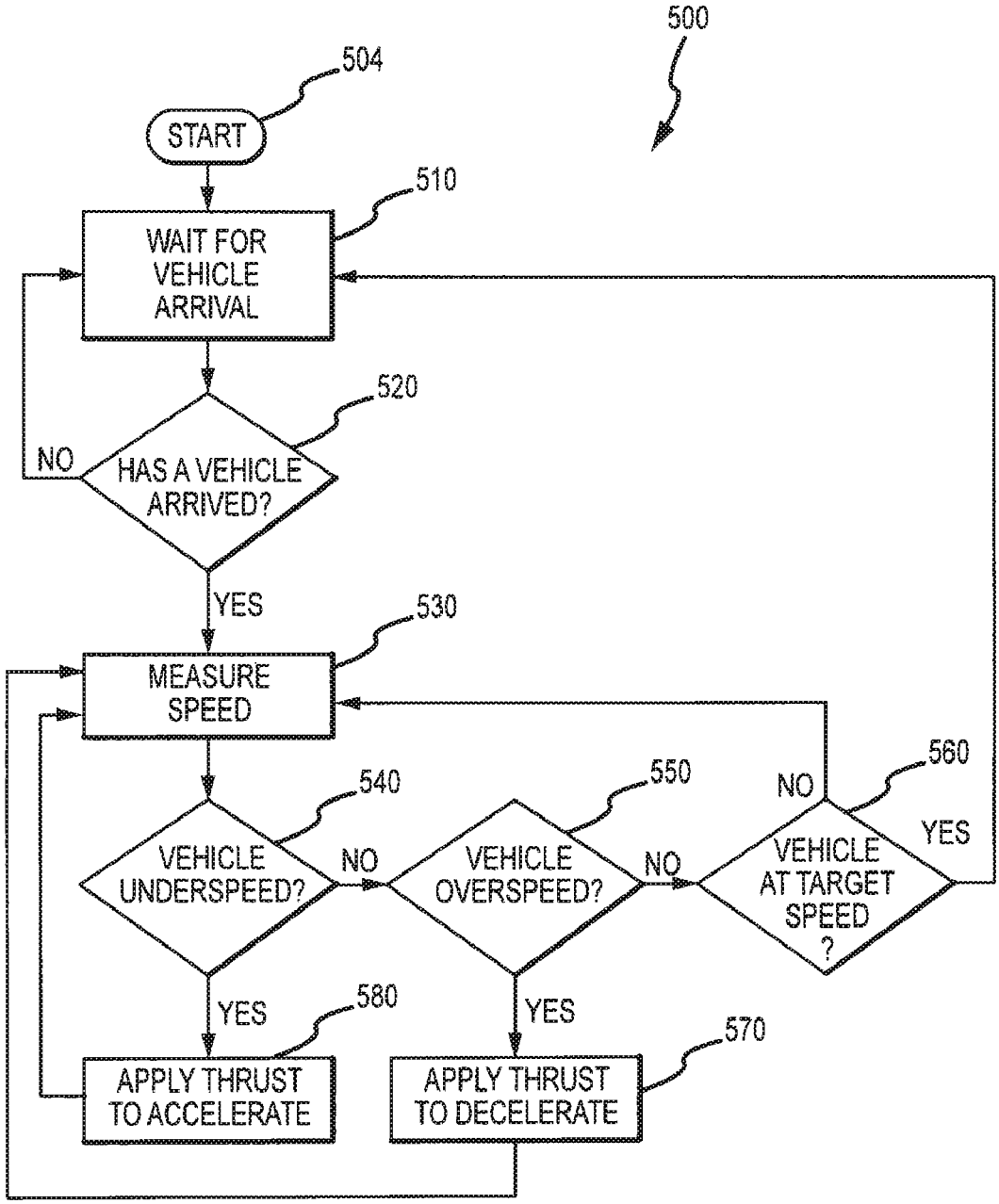
FIG. 5 illustrates a process flow for control of a magnetic pacer of embodiments of the invention such as may be implemented by the control processor shown in the system of FIG. 4.
Figure 6:
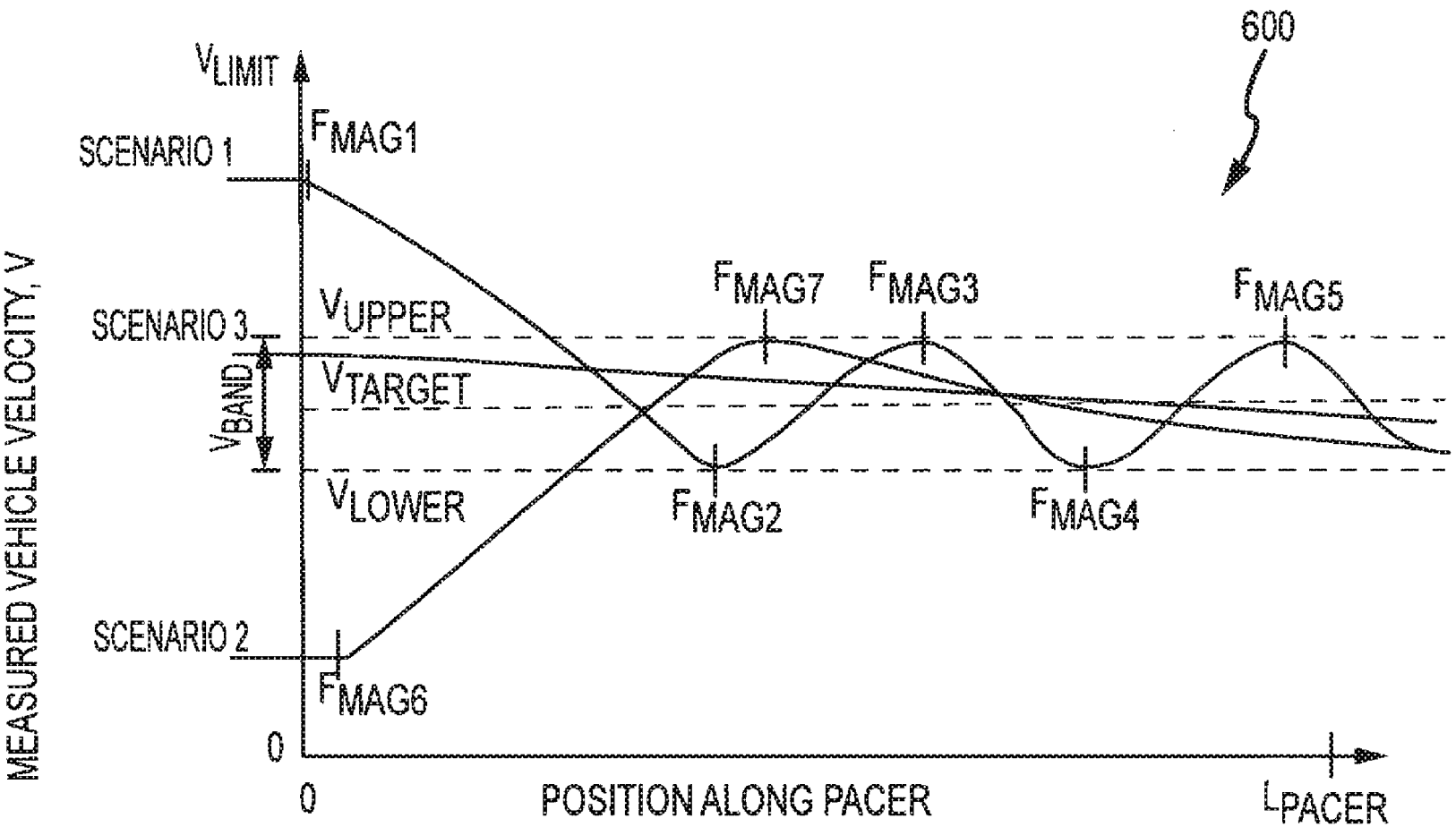
FIG. 6 a graph comparing measured velocity of ride vehicle (or train) to its position along a pacer (or series of one or more magnetic thrusters) illustrating various operating scenarios and potential results of applying magnetic forces or thrust with the pacer to control velocity of the vehicle.

FIG. 5 illustrates a pacer process or velocity control method 500 such as may be implemented by operation of the pacer assemblies of FIGS. 1-4. The method 500 starts at 504 typically with establishing communication and power connections between a control module and one or more magnetic thrusters or propulsive devices. Step 504 may also include establishing a goal velocity for the pacer assembly for vehicles or cars passing over or adjacent to the thrusters, which may include setting upper and lower bounds (or trigger points) about the goal velocity that are used to determine if the vehicle is over or under speed for the pacer assembly (e.g., a show portion of a ride that uses a pacer assembly to adjust vehicle speed). In some embodiments, the pacer assembly may be modular such that two or more goal velocities and/or upper and lower limits are applicable. For example, it may be desirable for an initial or first portion of the pacer assembly to provide initial slowing of a vehicle (such cars in a coaster train) with later sections acting to provide a further slowing to a second velocity goal or to speed the vehicle to a higher second goal velocity. In other cases, two or more thrusters are utilized in a pacer assembly and these may be spaced apart such as in differing stretches of track, and their velocity parameters may differ (e.g., one may be set to a 3 meter/second pace while the second is set to a 8 meter/second pace). In other cases, more than one pacer assembly may be used for a ride with each assembly being run separately with its own velocity settings or parameters. Individual thrusters may also be capable of being set to varying speed targets. This is useful for interactive stories that change the experience based on guest actions or interactions. For example, one vehicle may run quickly (or at higher target velocity) through a scene because the passengers "hit" a specific target, push a button, yell at certain volume, or take other actions while the next vehicle would run more slowly (or at a lower target velocity) because they missed the target, did not push the button or pushed another button, made noise at a different volume, or otherwise took different actions than the preceding vehicle.

At 510, the method 500 continues with waiting for a vehicle to arrive, e.g., operating position or other sensors to continually or periodically monitor for a vehicle to pass over or proximate to a magnetic thruster or magnetic force generator. At 520, the method 500 includes checking for arrival of a vehicle and looping back to 510 until one arrives. At this point, the method 500 includes measuring the speed of the vehicle 530 such as by processing two or more position signals. At 540, the method 500 involves determining whether the vehicle is under speed, which may include a comparison of the determined vehicle velocity with a goal or target velocity or with a lower bound that defines a velocity that is less than the target but still acceptably close in magnitude to the goal velocity. If the vehicle is determined under speed, at 580, the method 500 includes a controller operating to apply thrust to the vehicle to accelerate the vehicle. In other words, the controller controls and/or powers a magnetic thruster or propulsion device to create a magnetic field that applies a force to the vehicle that adds momentum (i.e., applies force that causes the vehicle to move more rapidly in the DOT). After (or while) the thrust is applied at 580, the speed may be measured again at 530 and testing for an under speed condition checked again at 540. The accelerating force at 580 may be short duration pulse, a force generated for a preset time period before performing 530 (e.g., there may be a built in delay or pause prior to determining how speed was affected by the step 580), or the accelerating magnetic force may be applied in an ongoing manner until the steps of 530 and 540 indicate the vehicle is no longer under speed (or even until a predefined value or magnitude of velocity above the trigger used for applying an accelerating force is achieved such as the goal velocity).

At 550, when the vehicle is not under speed, the method 500 includes determining whether the vehicle is over speed such as by comparing the determined vehicle velocity with a goal velocity or with a trigger velocity defining a velocity above the goal at which braking will be performed by the magnetic pacer assembly. If not over speed, the method 500 continues with determining whether the vehicle is at a target or goal speed (or within an acceptable range between the two trigger or bound velocity values). If so, the method 500 may continue with waiting for a next vehicle (or next train in some cases) with no further forces being applied to the vehicle, e.g., the vehicle is allowed to coast. If not, the method 500 loops back to 530 to perform another speed measurement. In other embodiments (not shown), even if a vehicle is determined to be at the target speed or within an acceptable velocity range, the method 500 will loop back to step 530 such that the speed will be monitored and adjusted as necessary whenever a vehicle is over or proximate to the pacer assembly and one or more of its magnetic thrusters (e.g., speed monitored along a substantial portion of or entire length of pacer).

At 570, if the vehicle is over speed, the magnetic thruster is operated to apply a thrust or resistive/braking force to the vehicle to decelerate the vehicle to try to pace the vehicle to the goal velocity. This typically involves a magnetic thruster being controlled and/or powered to generate a magnetic field that applies a force that is opposite the direction of the DOT (or at least not in the same direction as the DOT) or that removes momentum from the vehicle (which may or may not require a field that is opposite the DOT but may only require a transverse force). The method 500 then continues at 530 with repeating the measurement of the speed, and, as with the accelerating force applied at 580, the decelerating force may be applied as a pulse, for a preset time period, or until the vehicle is determined to be no longer over speed at 550 (or at least a speed that matches or exceeds the goal velocity).

FIG 6 illustrates a graph 600 showing the control process implemented by a magnetic pacer assembly of the invention (such as by operation of the controller 420 of FIG. 4). The graph 600 shows a measured velocity for a vehicle (e.g., as determined via use of position sensors or the like along with timing information) that passes over a magnetic thruster relative to the position of the vehicle along the length of the magnetic thruster or thrusters. The graph illustrates three typical operating scenarios for a pacer assembly, i.e., a first scenario in which the vehicle is traveling faster than desired for a section of track (such as a show portion), a second scenario in which the vehicle is traveling slower than desired for a section of track (such as for a show portion or as it approached a slope or other portion of track where a particular amount of momentum is required or desired for a ride effect), and a third scenario in which the vehicle is traveling within a desired velocity range or band about a target velocity, $V_{target}$, along the entire length of the pacer. The graph 600 also shows a velocity band that is defined by an upper velocity boundary or maximum velocity trigger, $V_{upper}$, and a lower velocity boundary or minimum velocity trigger, $V_{lower}$, that are provided above and below a target velocity, $V_{target}$ (e.g., a design velocity for a show portion of a ride).

In the first scenario, a velocity of the vehicle is measured at or near a leading edge of the pacer, and this velocity is well above the target velocity, $V_{target}$, and also above an upper velocity trigger, $V_{upper}$. The controller of the pacer assembly acts to operate the thruster (or thrusters as the vehicles of a train may be over more than one thruster at any particular point in time) to apply a magnetic force, $F_{MAG1}$, that resists travel in the DOT (e.g., a braking or resistive force is applied on a magnet array on the vehicle(s)). The speed of the vehicle is shown to be lowered as the vehicle travels along the pacer, with the speed being measured typically on a periodic basis such as shown in FIG. 3 with spaced apart position sensors providing position signals to a controller for use in velocity measurement. The velocity of the vehicle slows to a point where it enters the velocity band, $V_{BAND}$, such as due to continued application of a resistive or deceleration magnetic force, $F_{MAG1}$, or simply due to coasting and friction forces or other track conditions (e.g., a slope or curve that may remove momentum). When the vehicle's speed falls to a lower velocity trigger, $V_{lower}$, the controller acts to switch the direction of the magnetic thruster to apply an accelerating magnetic force, $F_{MAG2}$, or if the thruster was off (e.g., the initial resistive force was a pulse) the thruster is operated to provide this force. Again, this may be a pulse or ongoing force and speed measurement is continued and additional resistive (decelerating) and propulsive (accelerating) forces, $F_{MAG3}$, $F_{MAG4}$, $F_{MAG5}$, are applied to control the speed of the vehicle to keep its velocity within the desired velocity range or band, $V_{BAND}$. Scenario one may occur in a powered vehicle ride as shown in FIG. 2 or in a coaster-type ride as shown in FIG. 1 when there is a relatively long flat stretch or stretch of track where speed control is important in a ride (such as long show section) which may be flat, inclined up or down, and curved (as the magnetic pacer assemblies can be used in sloped and curved sections of track in contrast to mechanical pacers). In other cases in which the initial speed is greater than a desired range, a single resistive force may be applied, and, in some cases, its magnitude and/or duration is selected based on the measured velocity and other factors (such as the weight of the vehicle(s)) to obtain a desired vehicle velocity (e.g., by removing a relatively precise amount of momentum to achieve a velocity within the desired range, $V_{BAND}$, for a portion of track).

In the second scenario, the initial vehicle velocity is determined to be outside of the desired velocity range, $V_{BAND}$, but lower than a lower bound or trigger value, $V_{lower}$. In this case, the controller acts to control and, or power the magnetic thruster or thrusters to apply a propulsive or accelerating magnetic force, $F_{MAG6}$, to the magnet array on the vehicle(s). When the vehicle speed is measured as at or above the upper bound or trigger value, $V_{upper}$, the controller functions to control and/or power the thruster or thrusters to generate a resistive or decelerating magnetic force that is applied to the magnet array of the vehicle(s). In this case, the combination of the accelerating and decelerating forces, $F_{MAG6}$ and $F_{MAG7}$, causes the vehicle(s) to remain in the desired range, $V_{BAND}$, for the remaining length of the pacer (e.g., for the show portion of the ride). In other cases, the initial accelerating force, $F_{MAG6}$, may be selected to be of an appropriate magnitude and/or duration to place the vehicle velocity in the range, $V_{BAND}$, and then released at a proper point to be able to coast at desired speeds. In other cases, multiple accelerating and decelerating forces may have to be applied to properly pace the vehicle (as shown with the first scenario).

In the third scenario, the initially measured vehicle velocity is within the desired velocity range, $V_{BAND}$, and speed measurements indicate that the vehicle never falls outside the range, $V_{BAND}$. Hence, the controller does not operate the magnetic thrusters at all for this vehicle. In other scenarios (not shown), the initial velocity and characteristics of the vehicle(s), track, and/or magnetic thrusters may be such that a decelerating or an accelerating magnetic force is applied for the entire length of the pacer but the vehicle never enters the desired range, $V_{BAND}$. In such cases, a later pacer assembly may be provided such that the initial pacer acts as a first stage (braking stage or accelerating stage) that is followed by a second (or more) stage that acts to place the vehicle's velocity within the desired range, $V_{BAND}$. In some cases, the pacer may be staged to only apply a limited amount of force to avoid exceeding a design restriction such as the amount of G forces that can be applied to passengers, and in these cases, the first stage thruster may be controlled and/or powered and/or sized to only provide an acceptable amount of decelerating or accelerating force. Later stages or modules may then apply additional magnetic forces to bring the vehicle velocity within the desired velocity range after this initial quick slowing or speeding up (e.g., after initial stage later "settling" stages may be provided to place the vehicle in a tight velocity band about a target velocity). It should be remembered that in some applications such as roller coasters the track configuration is designed such that the train may be traveling at near a "normal" or goal velocity when it enters a pacer controlled section of track, and, as such, the magnetic pacer assembly may not have to apply significant forces to pace the vehicle so as to bring the vehicle back to normal or target velocity. Vehicles may range significantly in weight with some approaching or exceeding 10,000 pounds, and it may be desirable to select the magnetic thrusters to be able handle such a weight capacity or be selected based on anticipated vehicle weights (when loaded) and anticipated speeds (such as up to or over 10 miles per hour). Of course, the magnetic forces applied in many applications are not required to provide full kinetic energy to a vehicle but, instead, may be considered tuning or pacing forces that are applied to remove or add smaller amounts of energy from a moving vehicle.

As shown in FIG. 6, the controller may be operated to apply initial magnetic forces at a greater magnitude and/or for a longer period of time to try to quickly bring the car to the proper speed or pace and then to apply later magnetic forces at smaller magnitudes and/or for shorter periods of time to maintain the vehicle at a velocity within a relatively tight band. In some applications, such as roller coasters, with multiple, connected vehicles this may result in greater forces being applied to lead vehicles and less to later vehicles (unless a large boost or acceleration is desired of a pacer), and, as a result, some pacer assemblies may be designed to account for this disproportionate forces with the lead vehicles containing the only magnet arrays or with other design adjustments.

It is anticipated that the magnetic pacer assemblies will provide many advantages over the use of mechanical pacers. For example, magnetic thrusters have the advantage of being touch free with no moving, wear, or replacement parts. They provide a propulsive or braking force using a magnetic field. This means that there are no parts that wear out during use, resulting in decreased maintenance costs and lower lifecycle costs. Magnetic thrusters provide improved reliability and very quiet propulsion and slowing/braking. In some cases, the use of magnetic thrusters may even provide an opportunity to use regenerative braking and recapture energy, and in almost all cases, these thrusters provide components with longer lives than with mechanical pacers. Magnetic thrusters and their controls can be provided in a small package (e.g., significant thrust in a relatively small piece of equipment), which facilitates use in locations where real estate/space is limited such as in indoor rides and facilitates maintenance (e.g., provides more ready access and does not necessitate large maintenance pits and the like as is often required with mechanical pacers). This also minimizes down time of the attraction if a failure does occur and the system needs to be replaced. Magnetic thrusters typically provide smooth acceleration and braking without the bouncing and jerking experience with many contact-based systems. Significantly, magnetic thrusters are operated in many embodiments to provide multi-directional forces to provide forward or backwards thrust (e.g., acceleration as well as deceleration or braking). The controllers of the assemblies of the invention also allow speed profiles (e.g., target velocities and upper and lower boundaries or trigger velocities) to be programmed, which allows the values to be readily changed such as a user I/O or GUI or the like that is used to access profiles in system memory. Magnetic thrusters such as LSMs allow tighter control of vehicle speed and can reduce the speed variations due to temperature, rain, and vehicle loads. Reduced speed variations may allow for improved THRC. A magnetic pacer would have better reliability and more consistent operation in a variety of environmental conditions (e.g., temperature, humidity, rain, snow, and the like) that would effect friction in a mechanical system.

In general, the pacer assembly detects when a vehicle enters its area of influence and determines the speed of the vehicle. In some embodiments, using pre-programmed tables, the controller operates the thruster to apply thrust or apply braking to adjust the vehicle's speed. Unfortunately, a magnetic system cannot hold a vehicle in one position. In all the traditional pacers, there is a mechanical interface and wear and tear results. Using an LSM or other magnetic thruster, this functionality can be duplicated and improved upon while the wear and tear is reduced or even eliminated. The vehicle may be outfitted with a magnet array (rotor) and the LSM stators or other magnetic field generators would be placed through out the ride such as in show portions. Speed adjustments are made to a vehicle at every pacer location or as needed to maintain a desired pace in these locations.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the magnetic pacer assemblies may be used in nearly any amusement park ride configuration or similar vehicle movement setting. In addition to powered cars and roller coasters, the assemblies may be used in omni-movers and also in vertical rides such as lift and drop rides in which the pacers of the invention may be used to pace the lift and/or the drop portion of the ride.

Further, the figures and examples provided generally showed a single direction of travel (e.g., the DOT 120 of FIG. 1), but the invention is not limited to travel in a single direction. Mechanical pacers, in contrast, are limited to providing braking or acceleration for a particular DOT. The magnetic pacers described herein, though, can be operated to provide acceleration or deceleration in any DOT in response to sensed velocities when compared with target velocities. For example, a single magnetic pacer can be used to accelerate or decelerate a vehicle traveling in a first DOT to try to obtain a target velocity or velocity within a target range and then to accelerate or decelerate another or the same vehicle as it travels in a second DOT (e.g., the opposite direction on a track) to obtain the same or a different target velocity or velocity range.

We claim:

1. A method of pacing a vehicle in an amusement park ride, comprising:

at a first location in the ride, releasing or launching the vehicle with energy to travel an entire length of a section of the ride;

providing a controller with memory storing speed settings for the vehicle in a portion of the ride;

positioning a plurality of magnetic thrusters proximate to the portion of the ride at a second location spaced apart from the first location within the section of the ride, the magnetic thrusters including at least one position sensor communicatively linked to the controller;

in response to a signal from the at least one position sensor after the releasing or launching, operating the controller to determine a velocity of the vehicle in the portion of the ride at more than one location along the portion of the ride;

with the controller, comparing the determined velocity with the stored speed settings;

determining a magnetic force to apply to the vehicle based on the comparing; and operating the magnetic thrusters to generate the magnetic force that acts upon the vehicle to pace the vehicle by selectively operating individual ones of the plurality of magnetic thrusters over the portion of the ride, wherein after operating the magnetic thruster to generate the magnetic force the vehicle continues to coast in a direction of travel at a velocity greater than zero and within a velocity range defined by the stored speed settings, wherein the vehicle is coasting at an initial velocity upon entering the portion of the track in the direction of travel that is within the velocity range, and wherein the magnetic force is selected in the determining to retain the vehicle at a velocity within the velocity range along the portion of the ride.

2. The method of claim 1, wherein the determining of the magnetic force comprises determining a direction of the magnetic force relative to a direction of travel of the vehicle, whereby the magnetic force is selected to be a decelerating force or an accelerating force.

3. The method of claim 2, wherein speed settings comprise an upper speed trigger and a lower speed trigger and wherein the determining of the magnetic force comprises applying the magnetic force as a decelerating force when the determined velocity is greater than about the upper speed trigger and as an accelerating force when the determined velocity is less than about the lower speed trigger.

4. The method of claim 1, wherein the vehicle comprises a magnetic array and wherein the magnetic thruster comprises at least one linear synchronous motor (LSM) and the operating comprises powering and controlling the at least one LSM to apply the magnetic force to the magnetic array to accelerate or to decelerate the vehicle along a present direction of travel for the vehicle in the portion of the ride.

5. The method of claim 1, further comprising in response to a second signal from the at least one position sensor, operating of the controller to determine a second velocity of the vehicle in the portion of the ride, comparing the second determined velocity with the stored speed settings, determining a second magnetic force to apply to the vehicle based on the comparing of the second determined velocity, and operating of the magnetic thruster to generate a second magnetic force to act on the magnet array of the vehicle, wherein the second magnetic force differs in at least direction from the magnetic force.

6. The method of claim 1, wherein the amusement park ride comprises a track upon which the vehicle travels and wherein the controlled portion of the ride comprises a curved or inclined section of the track.

7. A magnetic pacer assembly for pacing a vehicle that has an affixed magnet array and is traveling along a track or guideway, comprising:

a magnetic propulsion device positioned proximate to the track selectively operable to generate a magnetic field that applies a decelerating force upon the magnet array of the vehicle and to generate a magnetic field that applies an accelerating force upon the magnet array of the vehicle; wherein the magnetic propulsion device is provided at a first location in the track for applying a launching force with energy to travel an entire length of a section of the track, and further includes a plurality of magnetic thrusters proximate to the track at a second location spaced apart from the first location within the section of the track; and wherein individual ones of the plurality of magnetic thrusters are operated over the portion of the track;

a position sensor assembly; and a controller receiving position signals for the vehicle from the position sensor assembly, determining a velocity of the vehicle based on the position signals, and based on the determined velocity operating the magnetic propulsion device to generate the magnetic field corresponding to the decelerating force or to the accelerating force, wherein the position sensor assembly comprises a plurality of sensors positioned in a spaced apart manner along the length of the magnetic propulsion device and wherein the controller operates to receive the position signals as the vehicle travels along the length, to determine a velocity at more than one point along the length, and to operate the magnetic propulsion device more than once as the vehicle travels on the track proximate to the magnetic propulsion device to retain the vehicle at a velocity within the velocity range defined by the speed setting stored in a memory in the controller.

8. The assembly of claim 7, further comprising memory accessible by the controller that stores first and second velocity bounds defining a velocity range, wherein the controller operates the magnetic propulsion device to generate the magnetic field corresponding to the decelerating force when the determined velocity exceeds about the first velocity bound and operates the magnetic propulsion device to generate the magnetic field corresponding to the accelerating force when the determined velocity is less than about the second velocity bound.

9. The assembly of claim 7, wherein the operating of the magnetic propulsion device more than once comprises alternatively generating the magnetic fields associated with the decelerating and accelerating forces.

10. The assembly of claim 9, wherein the magnetic propulsion device comprises a plurality of linear synchronous motors (LSMs) arranged end-to-end along the track and wherein each of the LSMs is independently and concurrently operable to generate one of the magnetic fields.

11. The assembly of claim 7, wherein the controller selects magnitudes for the magnetic fields and the operating of the magnetic propulsion device comprises generating the magnetic fields with the selected magnitudes.

12. The assembly of claim 7, wherein the controller selects durations for the magnetic fields and the operating of the magnetic propulsion device comprises generating the magnetic fields with the selected durations.

13. An amusement park ride with enhanced pacing, comprising:

a plurality of vehicles for carrying passengers;

a track defining a path for the ride and supporting the vehicles, wherein the track includes a show portion;

a show system generating a show display when the vehicles are positioned in the show portion of the track, wherein the show display is adapted for the vehicles to travel through the show portion within a velocity range; and a magnetic pacer assembly comprising a magnetic thruster positioned adjacent the show portion of the track and a controller operating to determine a velocity of at least one of the vehicles in the show portion of the track and, based on the determined velocity, to operate the magnetic thruster to generate a magnetic field that applies a force upon at least one of the vehicles, wherein the force is a decelerating force when the determined velocity is greater than an upper limit of the velocity range and is an accelerating force when the determined velocity is less than a lower limit of the velocity range and wherein the controller operates a least a second time to determine a second velocity of at least one of the vehicles and, based on the determined second velocity, to second operate the magnetic thruster to generate a magnetic field that applies a second force upon the at least one of the vehicles that differs from the first applied force in at least one of direction and magnitude and p1 wherein the magnetic pacer assembly is provided at a first location in the track for applying a lunching force with energy to travel an entire length of a section of the track, and further includes a plurality of magnetic thrusters proximate to the track at a second location spaced apart from the first location within the section of the track; and wherein individual ones of the plurality of magnetic thrusters are operated over the portion of the track.

14. The amusement park ride of claim 13, wherein the magnetic thruster comprises a plurality of linear synchronous motors (LSMs) arranged in series along the track and wherein each of the LSMs are independently operable to generate a magnetic field that accelerates or decelerates the vehicles by applying the magnetic field to a magnetic array provided on the vehicles.

15. The amusement park ride of claim 13, wherein the show portion of the track comprises at least one curved or inclined portion.

16. The amusement park ride of claim 13, wherein the magnetic pacer assembly further comprises a plurality of position sensors positioned along the magnetic thruster and wherein the controller determines two or more velocities for at least one of the vehicles along the magnetic thruster and operates the magnetic thruster to generate magnetic fields based on the two or more velocities.

* * * * *

UNITED STATES PATENT AND TRADEMARK OFFICE

CERTIFICATE OF CORRECTION

PATENT NO. : 8,117,968 B2
APPLICATION NO. : 11/934899
DATED : February 21, 2012
INVENTOR(S) : Rose et al.

It is certified that error appears in the above-identified patent and that said Letters Patent is hereby corrected as shown below:

Column 22, line 28, after “magnitude”, insert --;--.
Column 22, line 30, delete “lunching” and insert therefor --launching--.

Signed and Sealed this
Fifteenth Day of May, 2012

David J. Kappos

David J. Kappos
*Director of the United States Patent and Trademark Office*